United States Patent [19]

Kern

[11] 4,033,001

[45] July 5, 1977

[54] SLEEPING BAG

[75] Inventor: Margaret Jean Kern, Port Colborne, Canada

[73] Assignee: The Raymond Lee Organization, Inc., New York, N.Y. ; a part interest

[22] Filed: Apr. 26, 1976

[21] Appl. No.: 680,285

[52] U.S. Cl. ..... 5/343; 2/83

[51] Int. Cl.[2] ..... A47G 9/00

[58] Field of Search ..... 2/69.5, 80, 83; 5/343

[56] References Cited

UNITED STATES PATENTS

| | | | |
|---|---|---|---|
| 2,121,788 | 6/1938 | Daiber | 2/83 |
| 2,131,898 | 10/1938 | Milkes | 2/83 |
| 2,234,546 | 3/1941 | Basch | 2/69.5 |
| 2,319,958 | 5/1943 | Taylor | 2/69.5 |

*Primary Examiner*—Paul R. Gilliam
*Assistant Examiner*—Andrew M. Calvert
*Attorney, Agent, or Firm*—Daniel Jay Tick

[57] ABSTRACT

A sleeping bag has a hood back part having a pair of arm and hand portions extending from opposite sides thereof. A lower back part is affixed to and extends from the hood back part. A hood front part has a face opening therein and a pair of arm and hand portions extending from opposite sides thereof and corresponding to the arm and hand portions of the hood back and affixed to the hood back part to accommodate the head, upper chest area and arms of a user of the bag. A lower front part is affixed to and extends from the hood front part and is affixed to the lower back part to accommodate the remaining torso of a user of the bag.

2 Claims, 6 Drawing Figures

SLEEPING BAG

BACKGROUND OF THE INVENTION

The present invention relates to a sleeping bag.

Objects of the invention are to provide a sleeping bag of simple structure, which is inexpensive in manufacture, and functions efficiently, effectively and reliably to provide full warmth and security to a user at the same time that it provides free mobility of the arms and hands of the user. The sleeping bag of the invention also covers and secures the head of the user to provide warmth and security of the head as well as the rest of the body.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
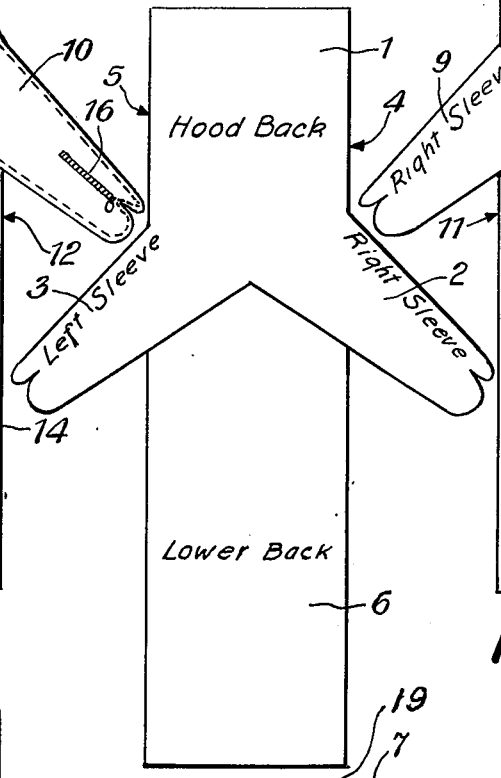
FIG. 2 is a rear view of the embodiment of FIG. 1 when it is not in use.
Figure 3:
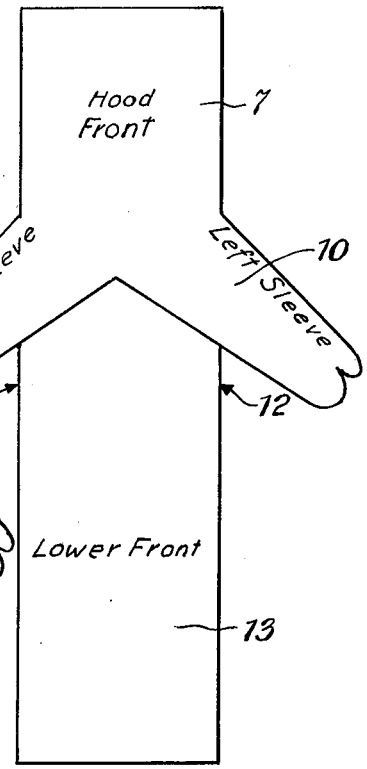
FIG. 3 is a front view of the embodiment of FIG. 1 when it is not in use.

The sleeping bag of the invention comprises a hood back part 1 (FIGS. 2 and 6) having a pair of arm and hand portions 2 and 3 (FIG. 2) extending from opposite sides 4 and 5 thereof (FIG. 2).

A lower back part 6 (FIGS. 2 and 6) is affixed to, and extends from, the hood back part 1.

Figure 1:
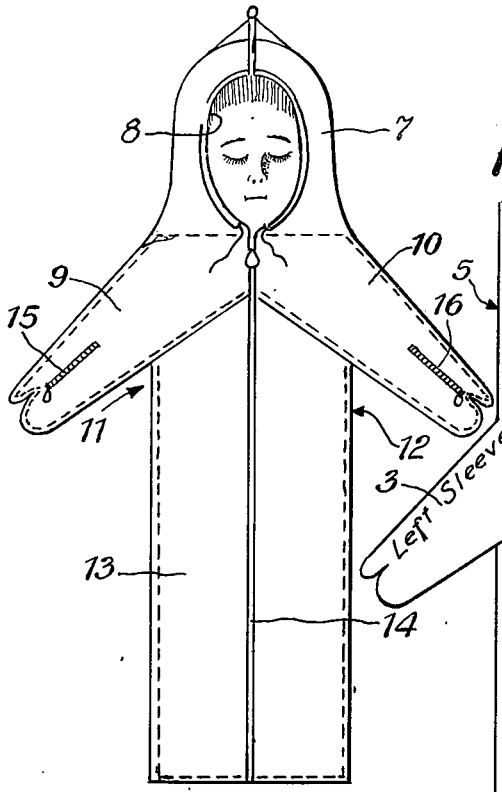
FIG. 1 is a front view of an embodiment of the sleeping bag of the invention in use.

A hood front part 7 (FIGS. 1 and 3 to 6) has a face opening 8 therein (FIGS. 1 and 5) and a pair of arm and hand portions 9 and 10 extending from opposite sides 11 and 12 thereof (FIGS. 1 and 3 to 5) and corresponding to the arm and hand portions 2 and 3 of the hood back part 1. The hood front part 7 is affixed to the hood back part 1 to accommodate the head, upper chest area and arms of a user of the bag.

A lower front part 13 (FIGS. 1 and 3 to 6) is affixed to, and extends from, the hood front part 7 and is affixed to the lower back part 6 to accommodate the remaining torso of a user of the bag.

A zipper 14 (FIGS. 1 and 5) extends down the center of the hood front part from the face opening 8 thereof and down the center of the lower front part 13.

A pair of wrist zippers 15 and 16 (FIGS. 1 and 5) are provided in the areas of the wrists of the arm and hand portions 9 and 10, respectively, of the bag to permit a user to extend his hands out of the bag while he is in the bag.

Figure 4:
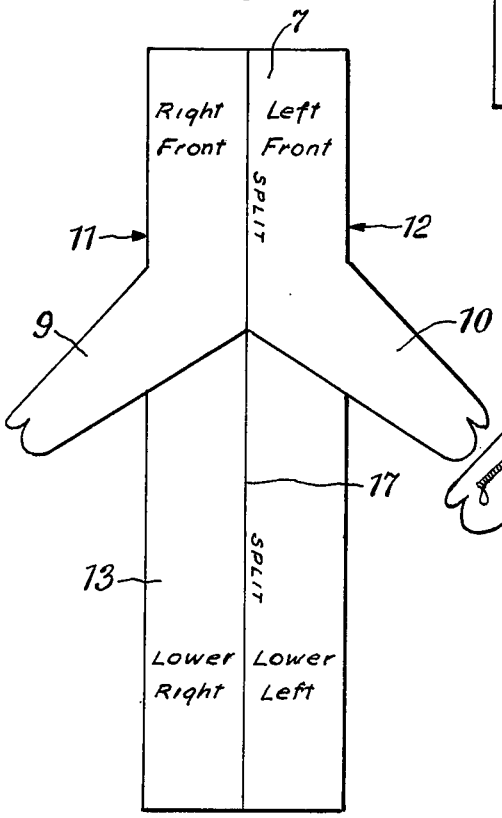
FIG. 4 is a front view of the embodiment of FIG. 1 showing the seaming thereof.
Figure 5:
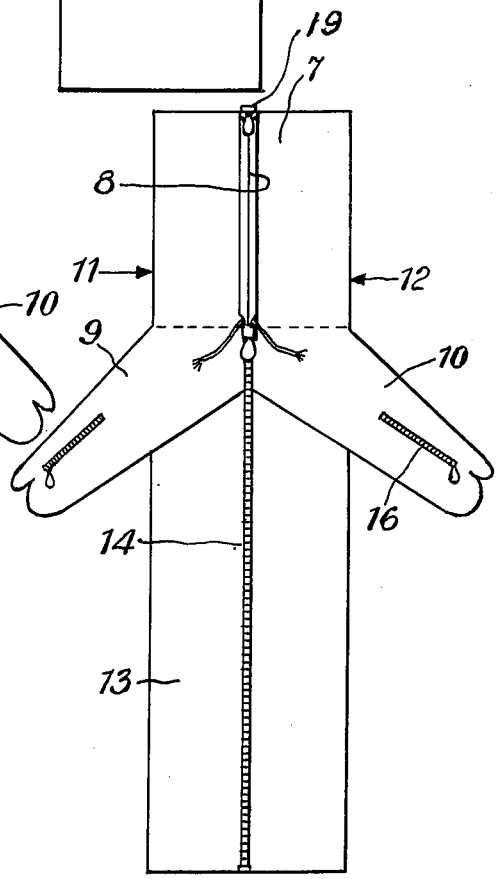
FIG. 5 is a front view of the embodiment of FIG. 1, showing the zippers in detail.
Figure 6:
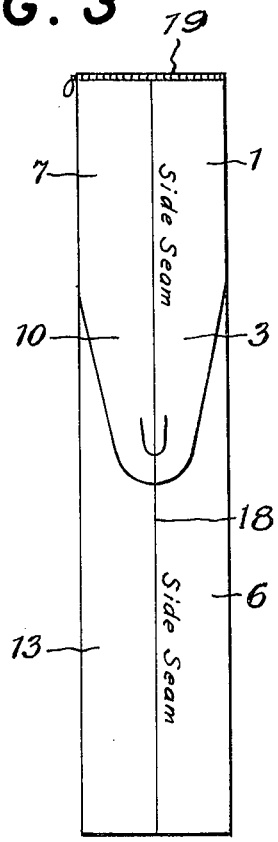
FIG. 6 is a side view of the embodiment of FIG. 5.

The bag of the invention may be sewn in four principal segments, as illustrated in FIGS. 4 and 6. Thus, each of the front and back parts is divided into a right part and a left part and joined to the other by a seam. The right front half is sewn to the right back half along a right side seam and the left front half is sewn to the left back half along a left side seam. FIG. 4 shows the center seam 17 of the front halves and FIG. 6 shows the left side seam 18.

A zipper 19 (FIGS. 5 and 6) is provided at the top of the hood. The zipper 19 permits the hood to be opened along the center of its top so that a user of the sleeping bag of the invention may have his or her head free and uncovered.

While the invention has been described by means of a specific example and in a specific embodiment, I do not wish to be limited thereto, for obvious modifications will occur to those skilled in the art without departing from the spirit and scope of the invention.

I claim:

1. A sleeping bag, comprising a hood back part having a pair of enclosed arm and hand portions extending from opposite sides thereof;

a lower back part affixed to and extending from the hood back part;

a hood front part having a face opening therein and a pair of enclosed arm and hand portions extending from opposite sides thereof and corresponding to the arm and hand portions of the hood back part and affixed to the hood back part to accommodate the head, upper chest area and arms of a user of the bag;

a lower front part affixed to and extending from the hood front part and affixed to the lower back part to accommodate the remaining torso of a user of the bag; and a zipper extending down the center of the hood front part from the face opening thereof and down the center of the lower front part to the bottom edge thereof.

2. A sleeping bag, as claimed in claim 1, further comprising a pair of wrist zippers in the areas of the wrists of the arm and hand portions of the bag to permit user to extend his hands out of the bag while he is in said bag.

* * * * *